US007845526B2

(12) United States Patent
Lonati

(10) Patent No.: US 7,845,526 B2
(45) Date of Patent: Dec. 7, 2010

(54) MACHINE AND METHOD FOR HANDLING TUBULAR MANUFACTURED ITEMS

(75) Inventor: Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 1304 days.

(21) Appl. No.: 11/373,920

(22) Filed: Mar. 13, 2006

(65) Prior Publication Data

US 2006/0213925 A1 Sep. 28, 2006

(30) Foreign Application Priority Data

Mar. 14, 2005 (IT) ..... BS2005A0034

(51) Int. Cl.
*A47G 25/80* (2006.01)

(52) U.S. Cl. ..... 223/111; 223/66

(58) Field of Classification Search ..... 223/112; 112/12

See application file for complete search history.

(56) References Cited

U.S. PATENT DOCUMENTS 4,343,254 A * 8/1982 Takatori ..... 112/475.16
4,421,259 A * 12/1983 Sewell et al. ..... 223/76
4,515,299 A * 5/1985 Sewell et al. ..... 223/76
4,658,995 A * 4/1987 Teague ..... 223/76
5,544,603 A 8/1996 Bell et al.
5,904,279 A * 5/1999 Bertram et al. ..... 223/112
6,158,367 A 12/2000 Jordan et al.
7,049,621 B2 * 5/2006 Bassi ..... 250/559.4

FOREIGN PATENT DOCUMENTS

EP 1 063 335 A2 12/2000
EP 1 375 722 A1 1/2004
IT FI2002A000724 11/2002

* cited by examiner

*Primary Examiner*—Shaun R Hurley
*Assistant Examiner*—Andrew W Sutton
(74) *Attorney, Agent, or Firm*—Pearne & Gordon LLP

(57) ABSTRACT

A machine, and a related method, for automatically transferring tubular items for manufacturing men's socks, comprising a station (S1) for loading automatically the tubular items (1) arranged on a longitudinal axis thereof, a station (S2) for positioning the items in a direction parallel to the longitudinal axis thereof, a station (S3) for orienting angularly the items with respect to a rotation axis parallel to the longitudinal axis thereof, and a station (S4) for transferring along a transfer line (T) the oriented items, the transfer station comprising a first and a second leader for aligning a portion of the tubular items (1), in which the leaders are arranged one after the other along the transfer line (T) and are separated by a non-controlled section of said line, for correcting in the second leader possible errors of insertion of the item into said first leader.

6 Claims, 10 Drawing Sheets

S1
1
2
2
7
4
5
3
8
10

S1
S2
S3
S4
2
2
3
3
3
7
8'
8'
8''
8''
D

FIG. 6
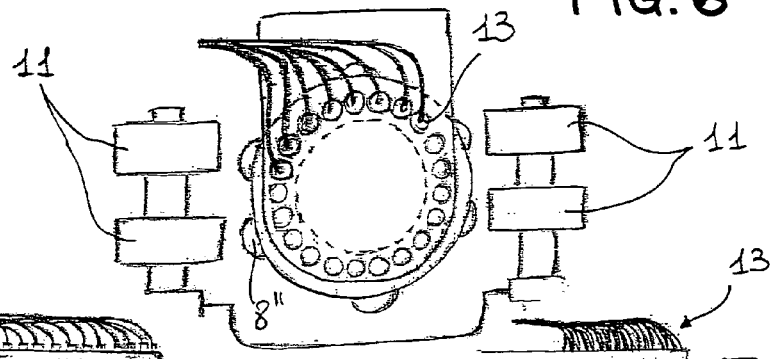
FIG. 7
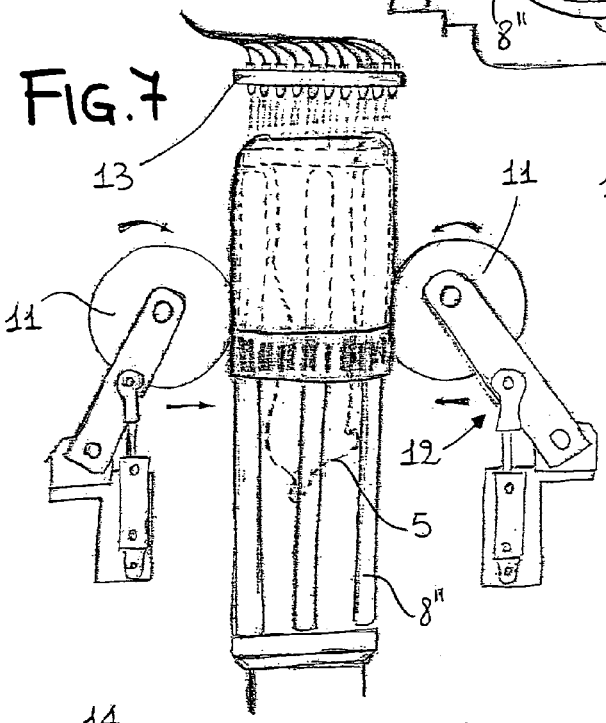
FIG. 8
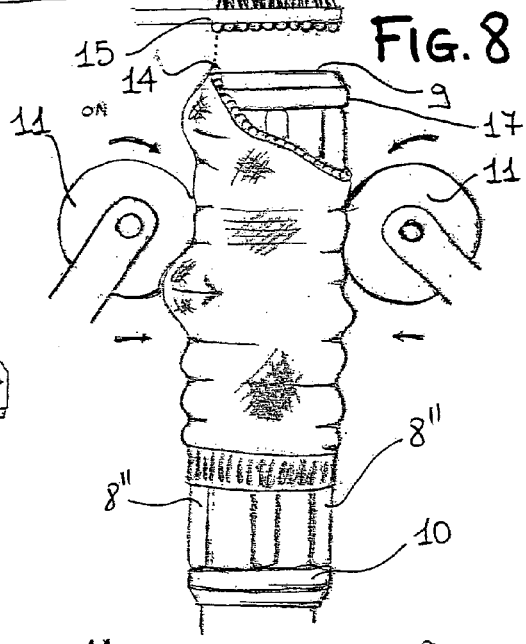
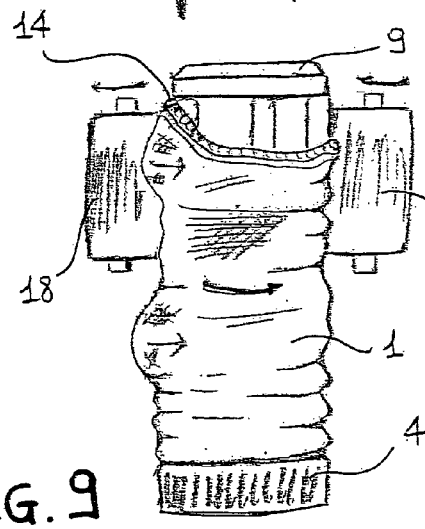
FIG. 9
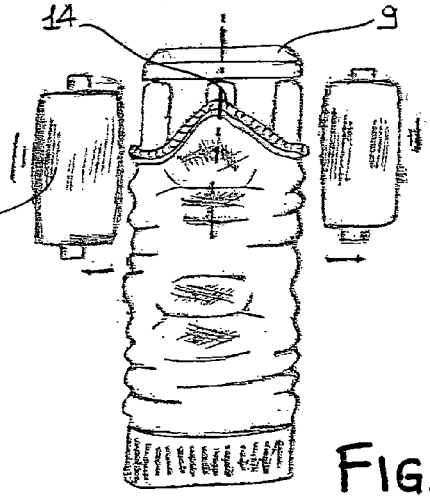
FIG. 10

FIG. 12
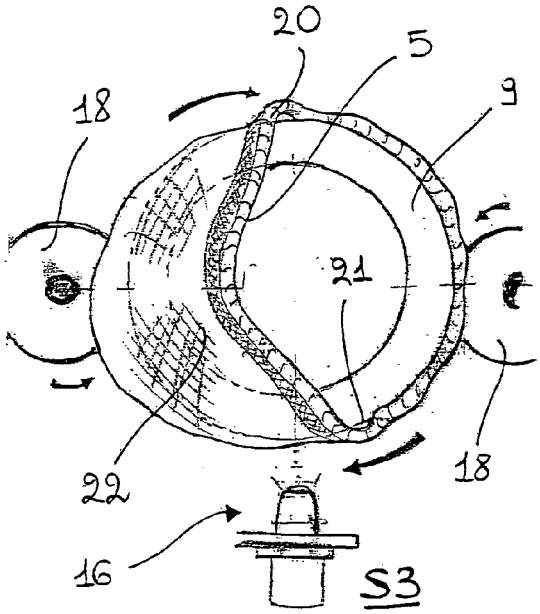
FIG. 13
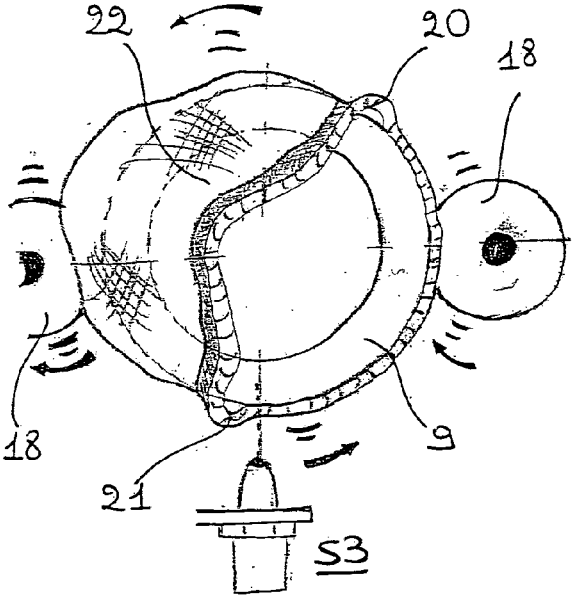
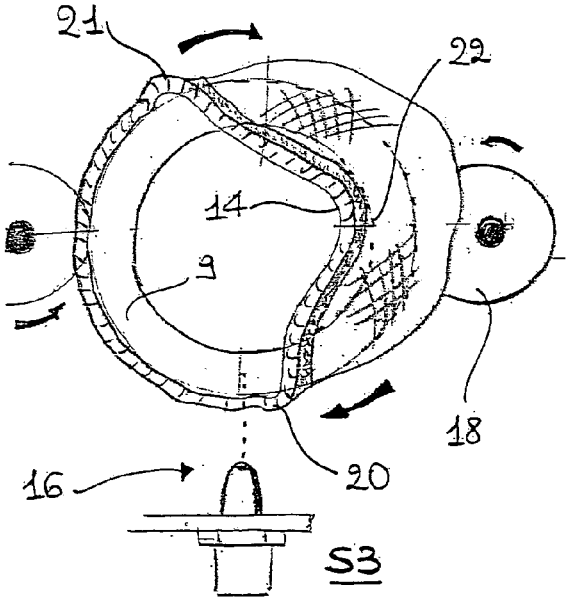
FIG. 14
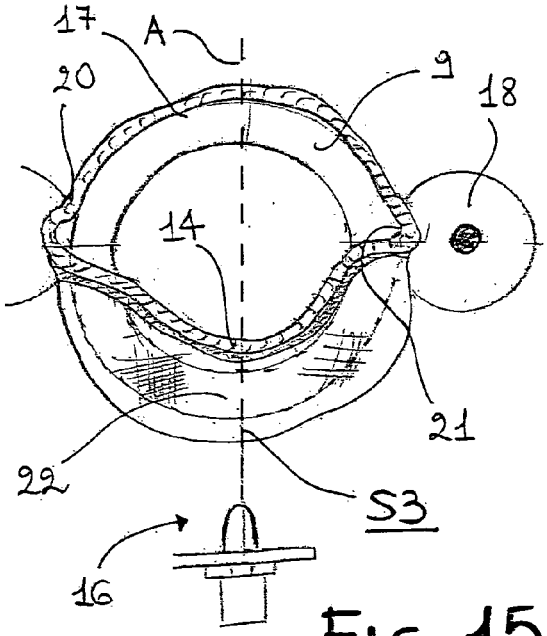
FIG. 15

50
39
41
29
36
27
32
33
38
5
26
1
T
S4
37
28
30
40
42
31
35
34
P1
P2
P3

MACHINE AND METHOD FOR HANDLING TUBULAR MANUFACTURED ITEMS

The present invention relates to a method and to a machine for handling knitted tubular manufactured items, such as for instance socks and stockings.

In particular, the invention can be used in the final step when forming the aforesaid manufactured items.

It is known that the process for manufacturing socks and stockings involves producing with dedicated circular knitting machines a semi-finished item made up of a tubular element which is open both on the elastic side, from which knitting begins, and on the toe side, which thus has an opening to be closed in the following seaming/knitted-seaming step In order to end the manufacturing process the semi-finished items thus produced undergo a manufacturing step in a toe-seaming or knitted-seaming machine, in which they are placed as a rule manually by an operator. This manufacturing step is highly repetitive for operators and, more to the point, human intervention does not result in a particular value added also from an economic point of view.

From patent application no. FI2002A224 it is known about a machine for positioning and transferring automatically stockings to be inserted into a following seaming machine placed downstream.

However, though solving the drawbacks mentioned above as far as the automation of the transferring and positioning process is concerned, this known machine has some further drawbacks related to the correct insertion of the stockings in the following seaming step.

A first aim of the present invention, therefore, is to propose a system and a method for transferring in a correct and reliable manner a sequence of open tubular manufactured items, such as semi-finished men's socks, to a following manufacturing step, for instance involving toe seaming.

A further aspect of the invention relates to the preliminary preparation of the sock to be transferred to the following seaming step, during which it is important that the sock is arranged in the correct position and orientation so as to automate the following operation.

To this purpose the aforementioned patent application FI2002A224 describes an optical system for detecting the position and orientation of colored marks provided on socks.

The position and orientation of each sock are then adjusted by means of suitable actuators controlled on the basis of the detected optical signals.

Though efficient for socks provided with colored marks, the above-mentioned system cannot be used for generic socks without said marks.

A further aim of the present invention, therefore, is to propose an optical system for detecting the position and orientation of generic socks, i.e. without reference marks, to be transferred to a following manufacturing step.

This result has been achieved according to the invention by developing the idea of a method and a machine having the characteristics described in the appended claims.

One of the advantages of the present invention is that the whole automatic process for manufacturing socks and stockings, and in particular the transfer of the socks to the final seaming step, can be carried out in a reliable manner without a direct human intervention, being it thus possible to increase plant productivity both on a quantitative and on a qualitative level.

A further advantage is the universality of the optical system for monitoring the position and orientation of socks, which works also for socks without reference marks.

A still further aim consists in that the number of operating stations required for the automatic transfer of the manufactured item can be reduced.

These and other aims of the present invention will be better understood by every skilled technician thanks to the following description and to the accompanying drawings, which are practical examples of the invention and not to be regarded as limiting, and in which.

Figure 2:
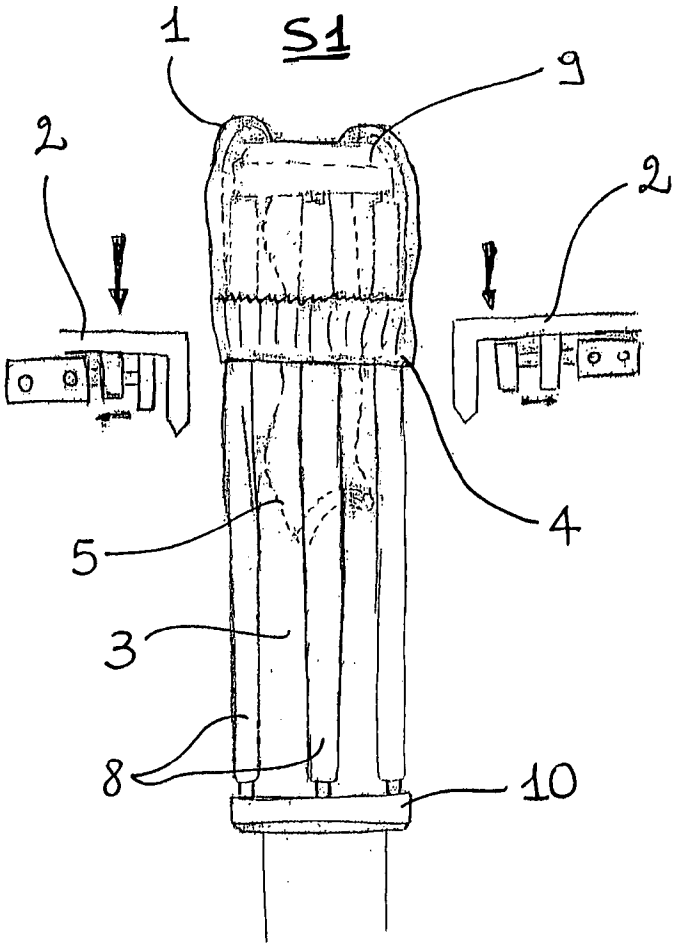
FIG. 2 shows schematically a semi-finished item fitted onto a loading tube of the machine of FIG. 1.
Figure 11:
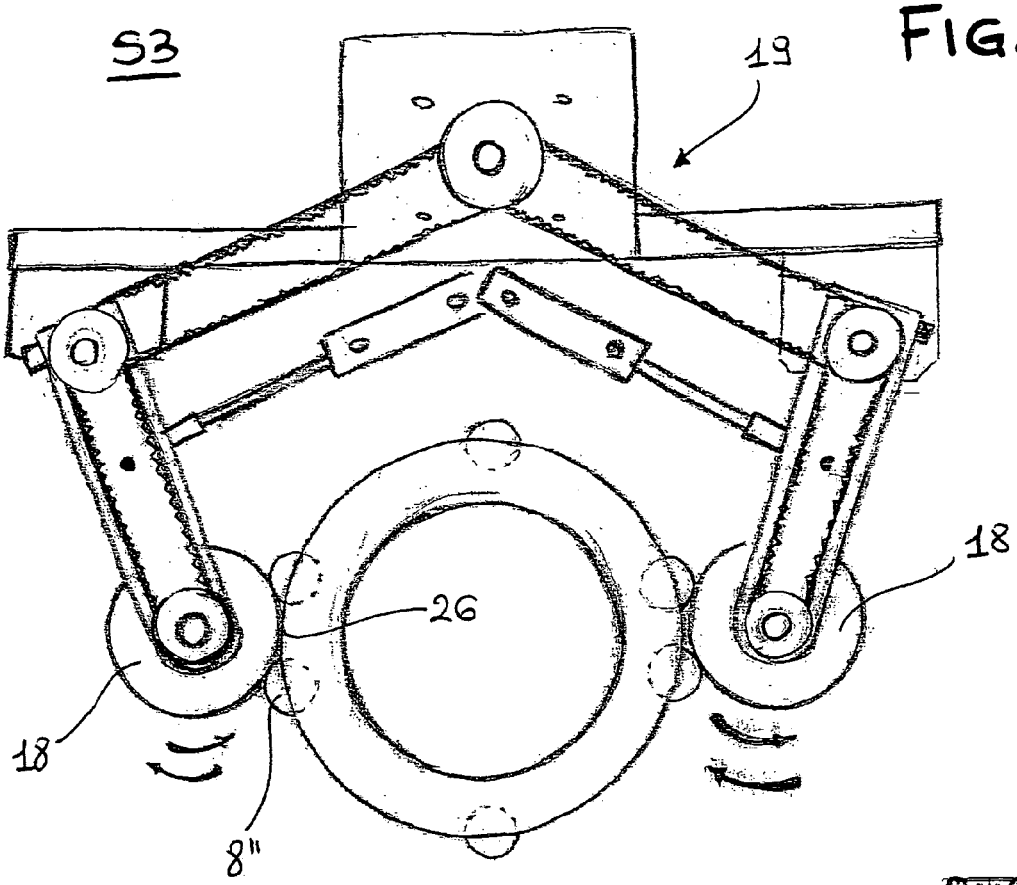
Figure 2A:
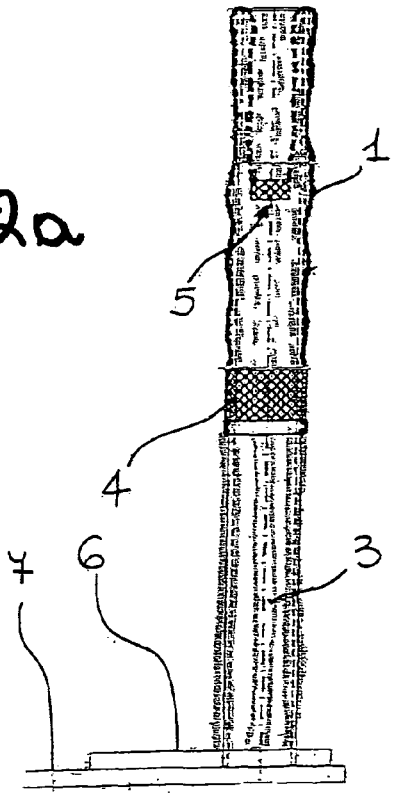
Figure 3:
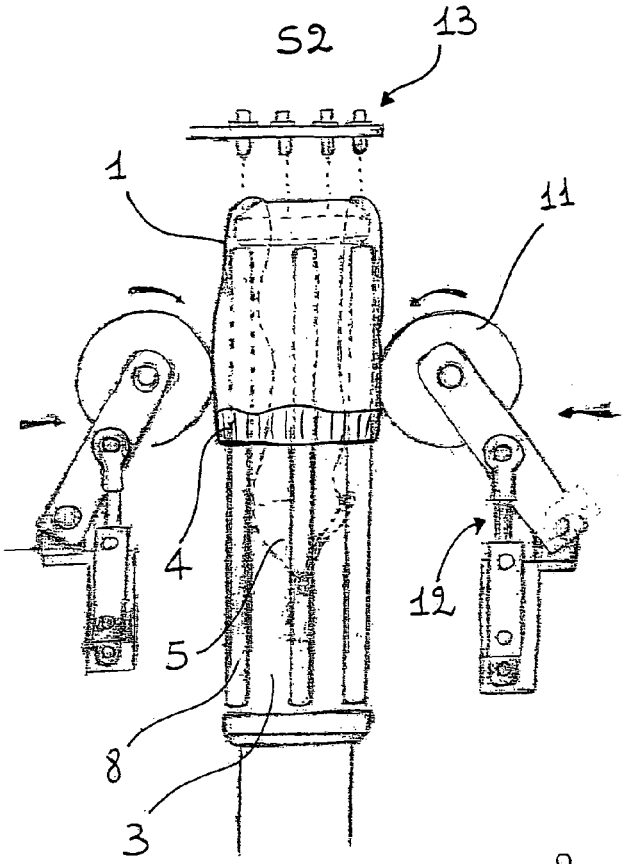
Figure 4:
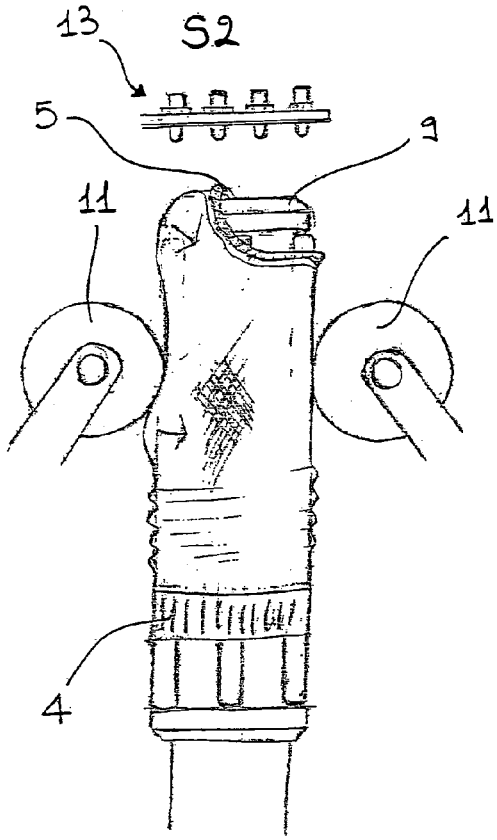
Figure 5:
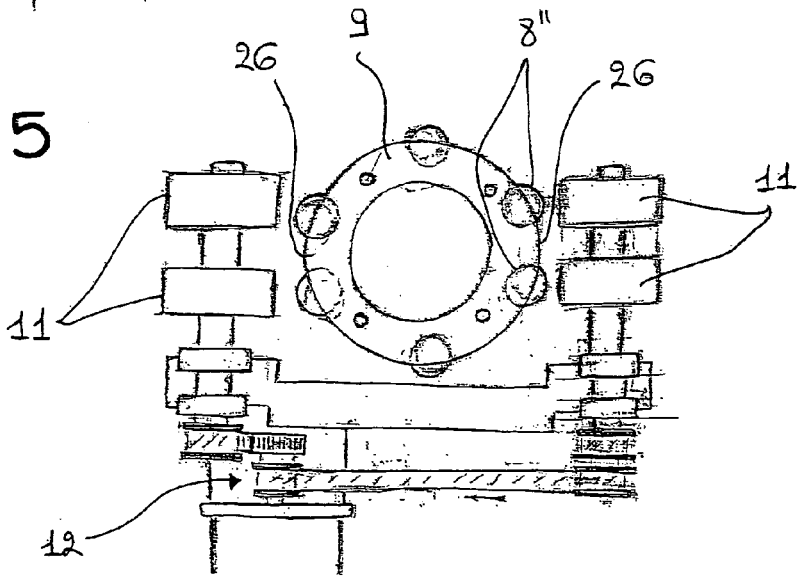
Figures 16, 17, 18:
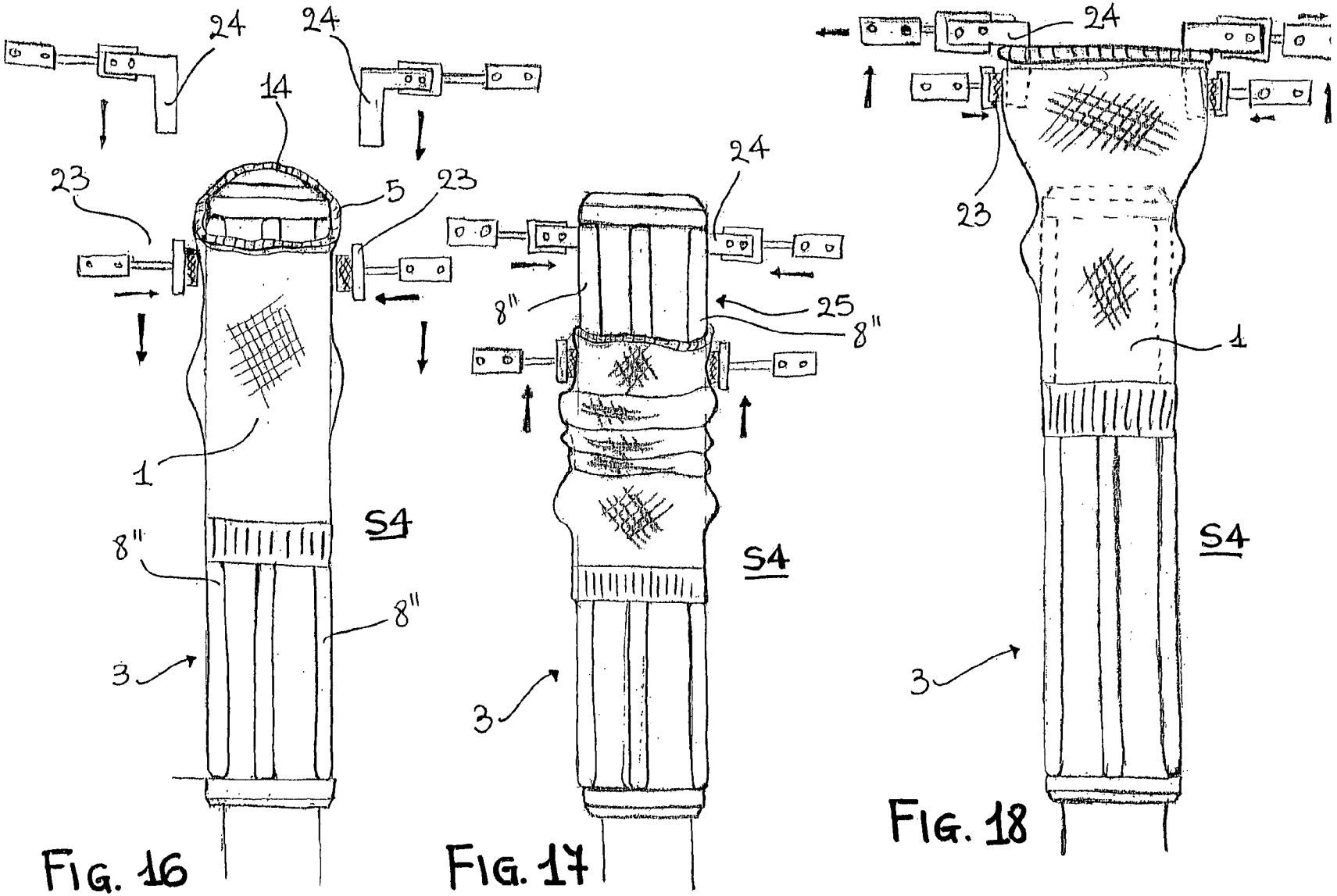
Figure 20:
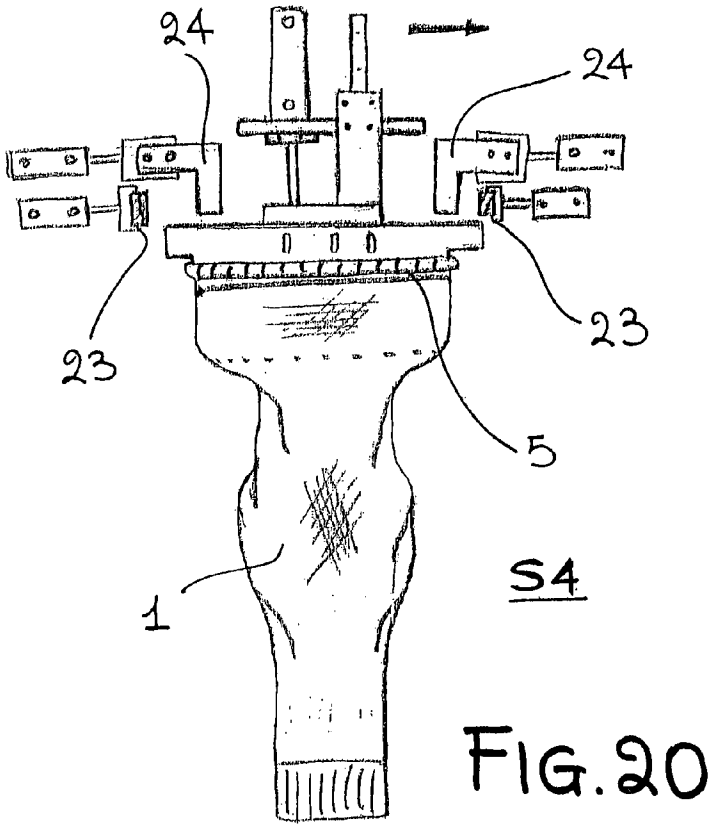
Figure 19:
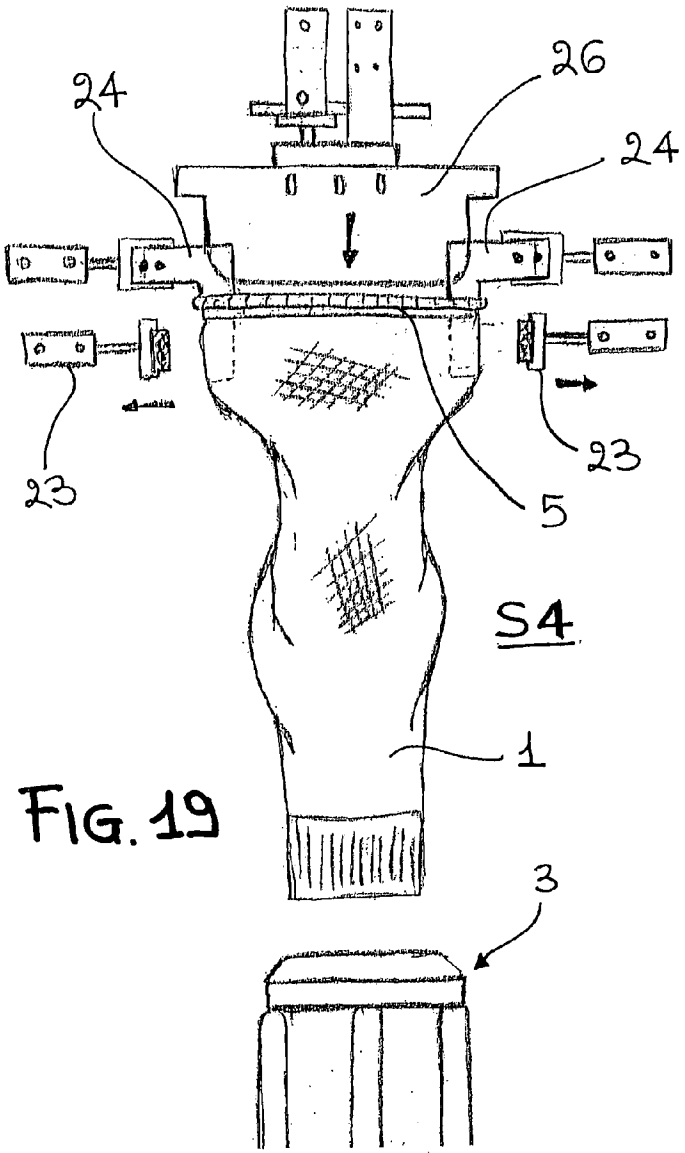
Figure 22:
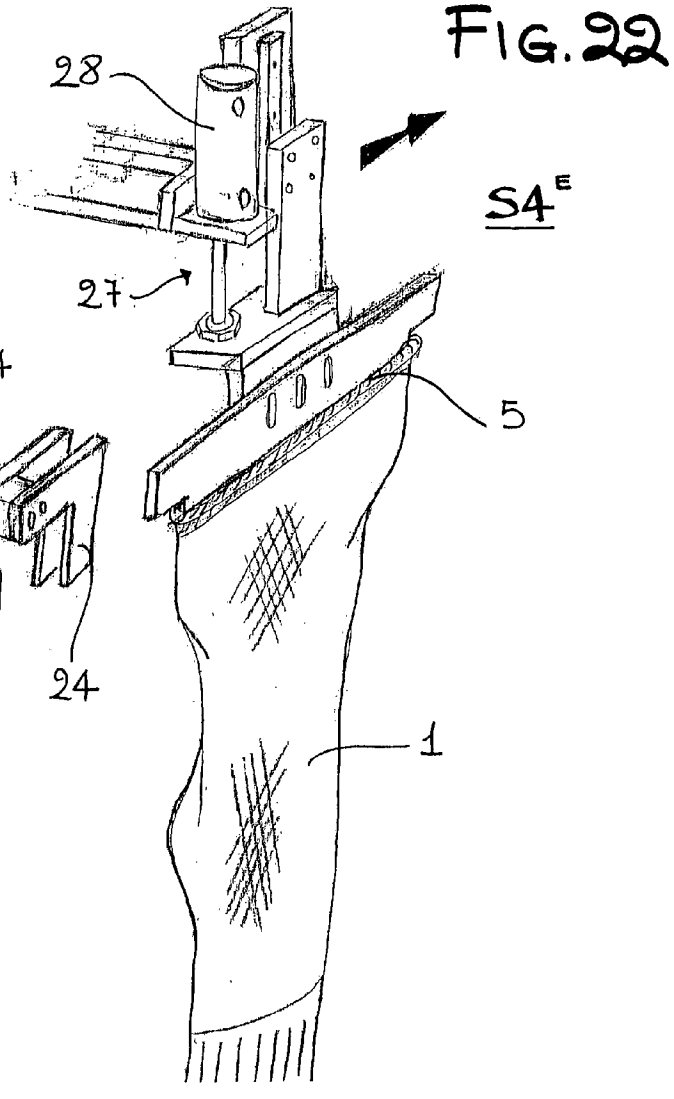
Figure 21:
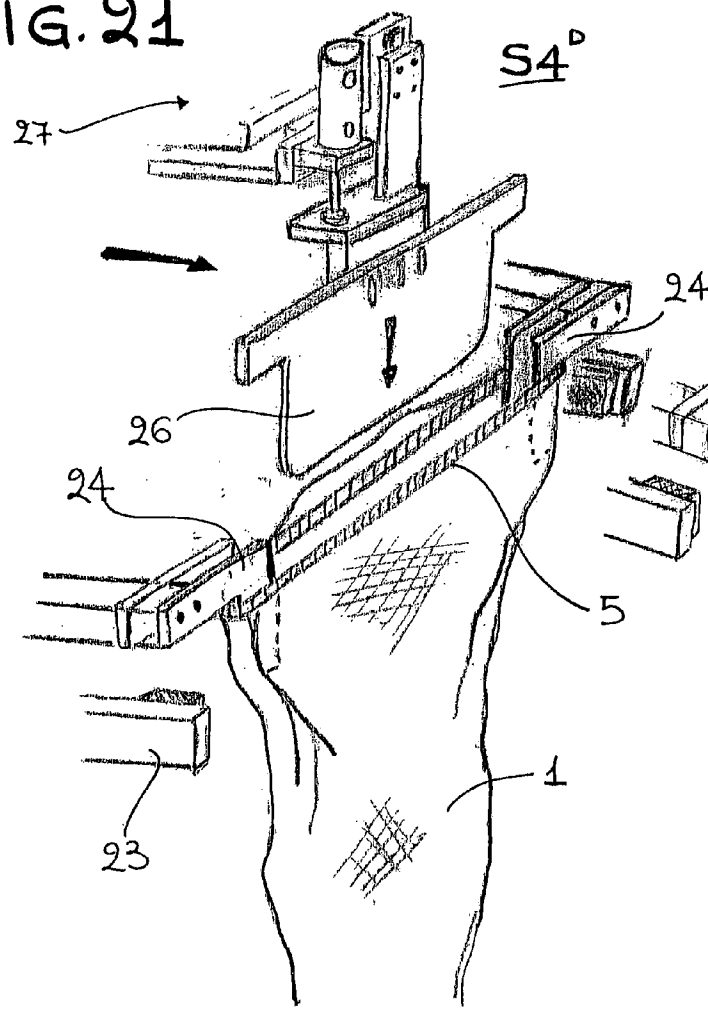
Figures 23, 24, 25:
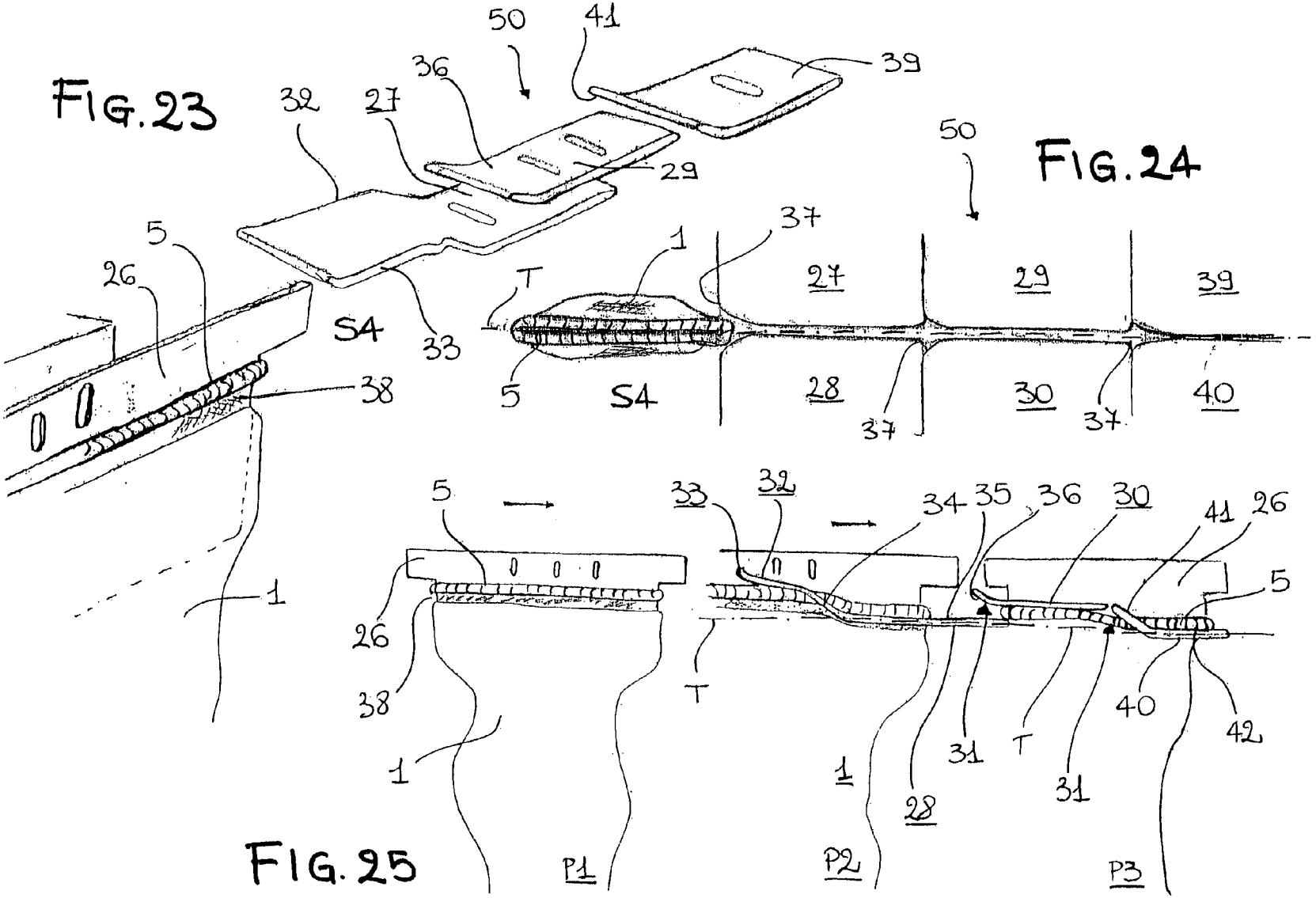
Figure 26:
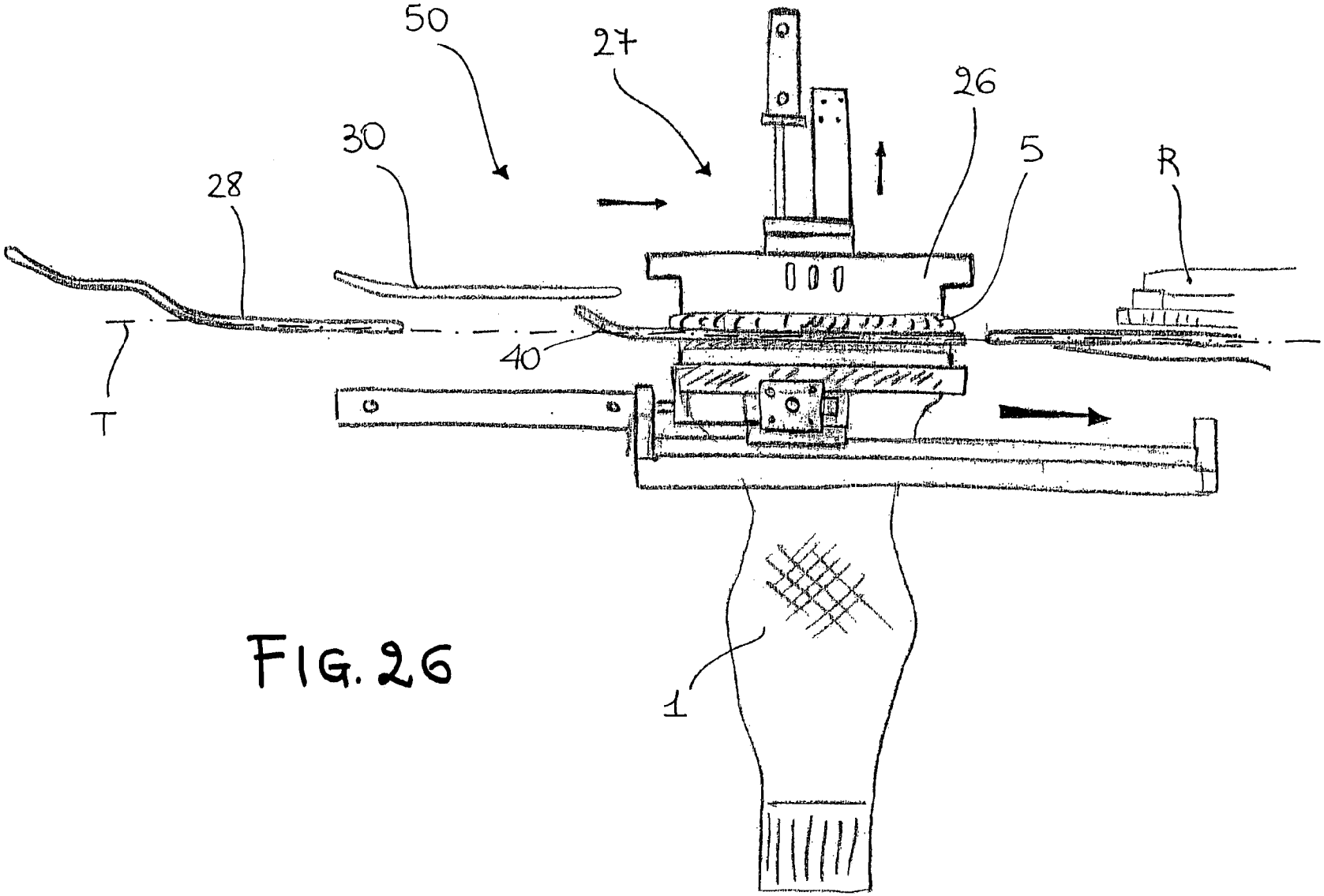

FIG. 2*a* shows schematically a loading tube vertically applied to turning carousel of the machine;

FIG. 3 shows schematically a loading tube in the positioning station of the machine, and a device for fitting a manufactured item onto the tube during the step involving positioning of the manufactured item;

FIG. 4 shows the final moment of an example of a first embodiment of the step involving positioning of the manufactured item in a machine according to the invention;

FIG. 5 is a top view of a loading tube in the positioning station of the machine;

FIG. 6 is a top view of a group of optical sensors placed above a loading tube in the positioning station of the machine;

FIGS. 7 and 8 are schematic views of the positioning station of the machine, in two consecutive moments, according to a second embodiment of the positioning step;

FIGS. 9 and 10 are schematic views of the orientation station of the machine, concerning consecutive moments, in an embodiment of the step involving orientation the manufactured items;

FIG. 11 is a schematic top view of the device for turning the manufactured item fitted onto the loading tube, in the orientation station of the machine;

FIGS. 12, 13, 14 and 15 are schematic top views of a loading tube in the orientation station of the machine, in consecutive moments of the orientation step following the positioning step according to FIG. 4;

FIGS. 16, 17, 18 are schematic side views of a loading tube and of the take-up device in the transfer station of the machine, in consecutive moments of the step involving taking-up of the oriented manufactured items from the tube, following the orientation step according to FIG. 15;

FIGS. 19, 20 are schematic side views of the device for taking up and transferring a manufactured item in the transfer station of the machine, in the consecutive moments of the final step involving taking-up of the manufactured item and beginning of transfer;

FIGS. 21 and 22 are perspective views of the take-up and transfer device of FIGS. 19 and 20;

FIG. 23 shows schematically a perspective view of a half of a device for leading the manufactured item according to the invention, in the final portion of the transfer step;

FIG. 24 is a top view of the leading device of FIG. 23, the initial position of insertion of the manufactured item into the leading device being shown;

FIG. 25 shows several side views of the manufactured item in consecutive moments of insertion into the leading device of FIG. 23 and of transfer of the manufactured item along said leading device;

FIG. 26 is a side view of the leading device of FIG. 23, the final position of the manufactured item before being transferred to following manufacturing step being shown.

With reference to the figures of the accompanying drawings, the method and the machine according to the invention can be used after the step involving manufacturing of the semi-finished item made up of a tubular element which is open both on the cuff and on the toe side.

Moreover, the machine according to the present invention is designed to work on a single semi-finished item already arranged in a pre-established way as far as the cuff and toe position is concerned.

A device for supplying the transfer machine with a sequence of open tubular manufactured items according to a pre-established cuff and toe orientation is already known in the field and will not therefore be described in further detail.

Figure 1:
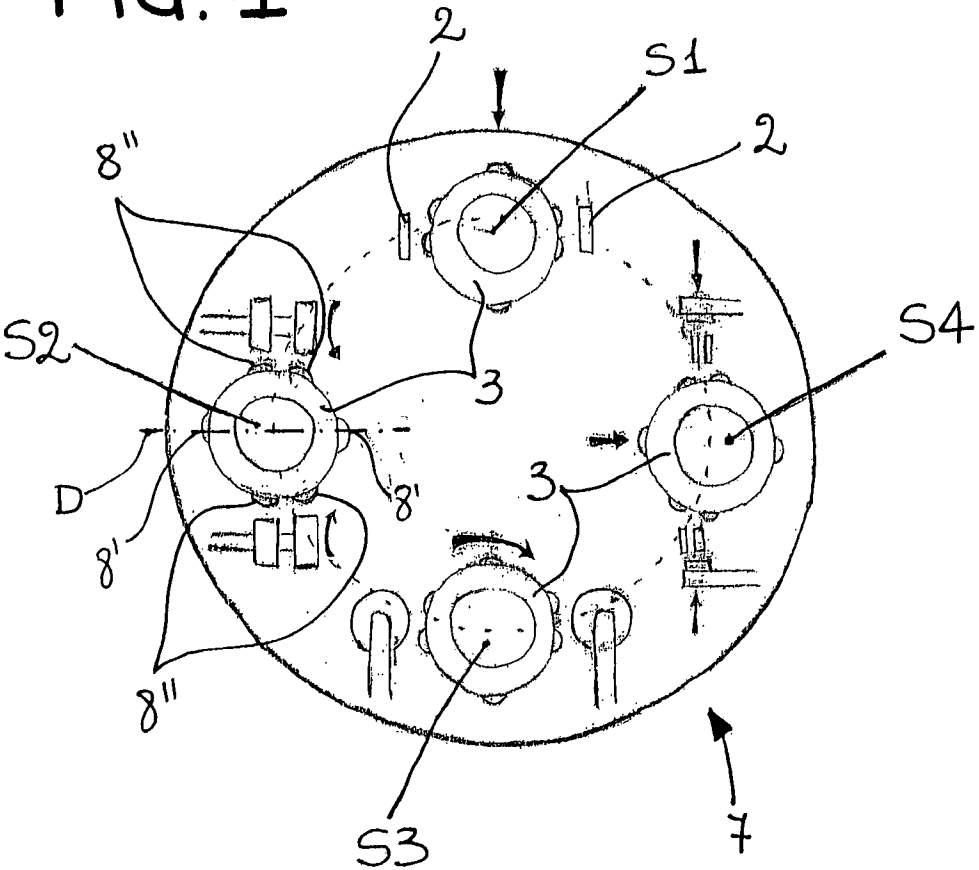
FIG. 1 shows a schematic plan view of a machine according to the present invention.

With reference to FIGS. 1 and 2, the "open" manufactured item is fitted onto a loading tube 3 by means of tongs 2.

The loading onto the tube is carried out by sucking up the toe (which as was said is still open) inside the tube and arranging the elastic, turned inside-out, on the outside of the tube.

The steps involving opening of the cuff of the manufactured item and insertion thereof onto the loading tube are not described or shown since they are known per se.

The step involving occurred loading is shown schematically in FIG. 2, which shows a manufactured item 1 whose cuff 4 is fitted onto a loading tube 3 and whose toe end 5, which is open, lies inside said tube.

The tube 3 can be carried by a corresponding support 6, as can be seen in FIG. 2A, which can be part of a carousel structure referred to as a whole with 7 in FIG. 1.

With reference to FIG. 2, the loading tube 3 is equipped with a series of rolls 8, which can make the item turn once it is fitted onto the tube.

In the example as described here, there are six rolls 8 mounted turnably parallel to the tube 3, between a peripheral base ring 10 and a ring-shaped cap 9 closing the tube edge above.

In the series of six rolls 8 as described here, two rolls 8' are arranged on the ends of a first diameter D of each tube 3, and the other four are arranged in two pairs of rolls 8" positioned on the ends of the diameter of the tube 3 perpendicular to the first one. The carousel structure 7 of the example of FIG. 1 is made up of four stations: a first loading station S1 receiving in sequence the manufactured items 1 coming from the manufacturing process upstream; a second station S2 for positioning the manufactured item 1 along a loading tube 3; a third station S3 for orienting the angular position of the manufactured item; and a fourth station S4 for transferring the manufactured item to a machine placed downstream, in the example as described here a toe-seaming or knitted-seaming machine R (shown in FIG. 26).

It should be pointed out that the carousel arrangement of the machine has proved particularly suitable and easy to be integrated into existing plants, though the structure and shape of the machine as well as the arrangement of the various operating stations can vary as required.

Once the loading step in the station S1 is over, the carousel 7 executes a rotation of 90° and brings the manufactured item 1 to the positioning station S2 (FIGS. 3-8).

In this station the manufactured item 1 is partially turned inside-out on the outside of the tube 3, so that it can be further fitted onto the tube by means of motorized friction wheel pairs 11 acting upon the outside of the tube 3 so as to stretch the item on the outer wall of said tube.

In particular, as can be seen better from the detail of FIG. 5, the wheels 11 are shifted by a compound lever, schematically referred to with 12, which supplies the wheels 11 with an approaching and removing motion with respect to the peripheral rolls 8".

In the side-by-side configuration of FIGS. 3 and 4, the wheels 11 rest on the item 1 on the surface of the rolls 8" and turn in the direction of the arrows, so as to take the item out from the inside and to fit it onto the outside of the tube.

FIGS. 3, 4 and 6 also show the position of a group of optical sensors 13 placed as shown above the tube 3 so as to "scan" the top surface of the cap 9.

The sensors 13 are designed to detect the position of the manufactured item during the rotation of the wheels 11, and to establish the end of the positioning step.

According to the invention, the sensors 13 can work at least in two distinct modes.

The first mode is shown schematically in FIG. 4 and is based on a part of the sensors 13 scanning an uncovered portion of the cap 9 due to the open end of the toe 5 of the item getting out.

Thus, by previously establishing which the final position of the portion or toe 5 and therefore the extension of the uncovered portion of the cap 9 should be, the scanning signals of the sensors 13 (which are sensitive to the passage of the toe edge and/or to the color change between the portion of the cap 9 still covered by the item and the uncovered portion) can be used for programming the blocking of the wheels 11.

FIGS. 7 and 8 show the second operating mode of the station S2.

In this case the event causing the blocking of the wheels 11, and therefore of the positioning step, is due to the scanning made by a sensor 15 detecting the passage of the last strip 14 of the toe 5 which completely uncovers the cap 9.

When the item 1 is a men's sock, thanks to the shape of the toe 5 end, the last strip 14 is necessarily made up of the farthest portion of the toe, on whose basis the position of insertion in the following seaming steps should be established.

As a consequence, in this mode of the positioning step, beyond the position of the item along the tube 3, also the position on the cap 9 of the strip 14 (corresponding to the position of the corresponding sensor 15 which last records its passage), and therefore the angular orientation of the sock to be seamed, can be established with the same scanning and, if necessary, in the same operating station.

In both cases, once the event determining the end of the positioning steps has been detected, the wheels 11 are blocked and removed from the tube 3, so as to enable the rotation step by step of the carousel 7 and lead the tube 3 into the orientation station S3.

With reference to FIGS. 9-15, the step of angular orientation of the item 1 is shown, which follows the positioning step described above.

In particular, FIGS. 12 to 15 describe the orientation step following a positioning of the manufactured item according to the first mode (FIG. 4).

In this case, the orientation station S3 contains a series of one or more optical sensors 16 arranged so as to scan at a vertical height corresponding to the top 17 of the cap 9.

The station S3 further contains motorized wheels 18, which can be handled by a compound lever 19 (shown in FIG. 11) so as to be approached and removed under control from the contact with the tube 3.

In particular, the wheels 18 can be approached on the pairs of turning rolls 8" until they rest on the manufactured item 1, so as to turn under control the item on the rolls 8.

According to the invention, the sensors 16 are sensitive to the passage of the two edge portions 20/21 of the toe 5 defining the uncovered portion of the cap 9. Thus, as shown schematically in the sequence of FIGS. 12 to 15, the sensor 16 can scan during the rotation of the item until it abuts first against the edge portion 21 (FIG. 12) and then the edge portion 20. Now the angular positions of the edges 20 and 21 have been found, and the position of the portion 22 of the toe 5 hanging over the cap can be calculated.

From here, by calculating the central point of the hanging portion 22 (coinciding with the forward strip 14 of the toe 5), a further rotation of the item can be obtained, until the strip 14 is led on a pre-established axis A, coinciding for instance with the scanning axis of the sensor 16.

FIGS. 9 to 10 show an orientation step following the positioning step described with reference to FIGS. 7, 8 and involving, as was seen, the detection of the angular position of the strip 14 which last uncovers the cap 9.

Once the angular position of the strip 14 is known, the wheels 18 are then only to be turned until the strip 14 is led on a desired position depending on the following manufacturing step.

At the end of the orientation step, the wheels 18 are removed from the tube 3 and the carousel 7 can execute a further step so as to lead the tube 3 in the transfer station S4.

With reference to FIGS. 16 to 18, they describe a device for taking up the manufactured item 1, previously positioned and oriented, from the loading tube 3.

In the embodiment described here, the taking-up device is made up of a pair of tongs 23 arranged on both sides of the tube 3 in the transfer station 4, which can seize the item laterally (FIG. 16) and lower it along the tube 3 until the cap 9 and a terminal section 25 of said tube are completely uncovered.

On the uncovered tube section 25, and preferably in the hollow space 26 between the rolls 8", L-shaped profiles 24 (FIG. 17) can be inserted radially, the size thereof being such that they are completely retractable with respect to the radial size of said rolls 8.

Once the profiles 25 are inserted retractably, the tongs 23 can get up and draw with themselves the item portion or toe 5 until they hang over the profiles 24. Now (FIG. 18) the tongs 23 and the profiles 24 keep laterally the item toe 5 and can take it off at the same time from the tube 3.

FIGS. 19 to 22 show the final part of the taking-up step, in which the tongs 23 open and let the sock free, and the profiles 24 get away from each other so as to stretch apart the toe 5 of the sock and enable the vertical insertion of a transfer template 26 (FIG. 19), until the toe 5 corresponds to a neck portion 38 which can be advantageously present in the template 26. In particular, the template 26, known per se, is handled by a group 27 shifting horizontally in a sock transfer direction and equipped with means 28 (for instance a vertical-stroke piston) for shifting vertically the template 26 and insert it into the open portion or toe 5 of the sock.

Once the template 26 has been inserted, also the profiles 24 can be taken out with a vertical motion (FIG. 20) and the sock can be transferred.

FIGS. 23 to 26 show the final step of controlled transfer of the manufactured item 1, fitted onto the template 26, from the transfer station S4 to the following manufacturing machine R.

According to the invention, the station S4 houses a leading device 50 for the item 1, comprising a first pair of opposed leading plates 27/28 at a pre-established distance on both sides of a horizontal transfer line "T" of the item 1, and then a pair of upper plates 29/30, and a second pair of leading plates 39/40 which are also opposed on both sides of the line T and downstream in the transfer direction of the item to the machine R.

In the example shown in FIGS. 23-26, the first plates 27, 28 comprise in the area for the insertion of the manufactured item 1 (left side in FIG. 25) a shaped profile made up of a guide opening 33 followed by a downwards inclined section 32, and preferably by a second inclined section 34 ending up in a rectilinear section 35 parallel and at the same vertical height as the transfer line T.

The upper plates 29/30 are staggered vertically with respect to the first plates 27/28 and show in their turn a profile made up of an inclined guide section 36 going on with a rectilinear section 30 arranged above the transfer line T.

Eventually, the second leading plates 39/40 have in their turn a profile made up of an inclined guide section 41 starting at the same height as the upper plates 29/30 and then descending going on with a rectilinear section 42, which is again aligned vertically with respect to the transfer line T.

FIG. 24 shows a top view of the leading device 50, from which it can be seen how the inlet sections 33, 36, 41 of the consecutive pairs of plates have a guide opening 37 also on the horizontal plane, so as to make the insertion of the item 1 easier.

FIG. 25 shows a side view of the consecutive positions taken on by the item 1 during its transfer along the leading device 50.

In the initial position P1, the item 1 is fitted onto the transfer template 26 with its toe 5 positioned just above the neck portion 38 of the template 26, should said neck portion be present.

Then the template 26 shifts along the transfer line T and an item portion, typically the toe 5, is inserted into the first pair of plates 27/28 through the horizontal 37 and vertical 33 guides.

Going on with the transfer of the manufactured item 1, since the toe 5 is thicker than the distance between the plates 27/28, it is trapped in its motion by the inclined sections 32 and 34 of the plates and deflected downwards, until it gets aligned along the section 35, the transfer line T (position P2) being led on the side and below by the first plates 27, 28. In its following shift (position P3), the toe 5 is no longer led on the side and below by the first plates and is conversely only held above by the pair of upper plates 29/30, so that the position of the manufactured item 1 can undergo adjustment shifts due for instance to creases or material build-ups as a consequence of an imperfect insertion into the first pair of plates. Going on with the transfer, the manufactured item shifts until it gets on the inclined section 41 of the second pair of plates 39/40, which again pushes the toe 5 between the lateral leading plates.

At the outlet of the leading device 50 (FIG. 26), the item 1 has its toe 5 led between the leading plates 39/40 and in the correct position so as to undergo the following manufacturing steps, such as knitted-seaming or seaming, in the downstream machine R. From the above description it is evident that the invention enables to obtain a better control of the transfer of the manufactured item than in known solutions, in which initial errors of insertion of the item into the guiding device, if present, are corrected automatically, without the need for human intervention, by the arrangement of consecutive lateral leading means separated by uncontrolled sections of the item.

It is also evident that the number and type of the leading means can vary depending on the desired application and on the item to be transferred.

The invention was described with reference to a preferred embodiment; however, execution details can change to the same extent as far as shape, size, element arrangement, material types are concerned, though without leaving the framework of the solution adopted and therefore within the limits of the protection conferred by the present patent.

The invention claimed is:

1. A method for transferring automatically tubular manufactured items for manufacturing men's socks, comprising:

a step of automatic loading of tubular items (1) arranged according to the longitudinal axis thereof;

a step of positioning of the items along a direction parallel to the longitudinal axis thereof;

a step of angular orientation of the items with respect to a rotation axis parallel to the longitudinal axis thereof;

a step of transfer along a transfer line (T) of the oriented items, characterized in that said transfer step comprises a step of leading of the item by means of a first and of at least one second lateral leading means of the tubular items (1), in which both leading means are arranged one after the other along the transfer line (T) of the items and are separated by a non-controlled section of said line, in order to correct in the second leading means possible errors of insertion of the item into said first leading means, wherein the positioning step comprises:

the insertion into a hollow tube (3) of a longitudinal portion of an open tubular item (1), starting from a free end of the hollow tube;

the controlled longitudinal loading of the item turned inside-out onto the outer wall of the loading tube starting from a first end (4) of said item and gradually pulling the portion housed therein; the positioning step being controlled by means of an arrangement of optical sensors (13) for detecting at least one longitudinal position of a second open end (5) of the item with respect to the free end of the loading tube and for operatively controlling said controlled longitudinal loading.

2. The method according to claim 1, in which said sensor arrangement (13) carries out a detection of the top position of the manufactured item on the free end of the loading tube (3).

3. The method for transferring automatically tubular items for manufacturing men's socks according to claim 1, in which said step of angular orientation comprises:

the loading onto a loading tube (3) of a tubular item fitted on an outer wall thereof starting from a first end of the item;

the controlled rotation of said item around a longitudinal axis; characterized in that the orientation step further comprises the detection by means of an arrangement of optical sensors (13, 16) of at least one angular position of the second open end of the item with respect to the free end of the loading tube, and the control of said turning means depending on the detected position.

4. The method according to claim 3, in which said sensor arrangement is arranged on at least one portion of the free end of the loading tube.

5. The method according to claim 3, in which said sensor arrangement is placed radially on at least one portion of the free end of the loading tube.

6. The method according to claim 4, in which said positioning and orientation steps (S3) are executed in the same operating station.

* * * * *

UNITED STATES PATENT AND TRADEMARK OFFICE

CERTIFICATE OF CORRECTION

PATENT NO. : 7,845,526 B2
APPLICATION NO. : 11/373920
DATED : December 7, 2010
INVENTOR(S) : Tiberio Lonati It is certified that error appears in the above-identified patent and that said Letters Patent is hereby corrected as shown below:

On the Title Page, Item (56) under References Cited, Foreign Patent Documents, please replace the Italian reference "FI2002A000724" with the following amended Italian reference number --FI2002A000224--.

Signed and Sealed this
Fifteenth Day of February, 2011

David J. Kappos

David J. Kappos
*Director of the United States Patent and Trademark Office*